US005494424A

United States Patent [19]

Schnell

[11] Patent Number: 5,494,424

[45] Date of Patent: Feb. 27, 1996

[54] SINGLE-STAGE VANE COMPRESSOR WITH WATER-COOLED JACKET

[75] Inventor: Manfred Schnell, Schopfheim, Germany

[73] Assignee: Mannesmann Aktiengesellschaft, Düsseldorf, Germany

[21] Appl. No.: 349,406

[22] Filed: Dec. 5, 1994

[30] Foreign Application Priority Data

Dec. 3, 1993 [DE] Germany ..... 43 41 720.5

[51] Int. Cl.[6] ..... F04C 18/344; F04C 29/04

[52] U.S. Cl. ..... 418/83

[58] Field of Search ..... 418/83, 85, 87

[56] References Cited

U.S. PATENT DOCUMENTS

| | | | |
|---|---|---|---|
| 901,539 | 10/1908 | Leyner | 418/83 |
| 1,895,816 | 1/1933 | Pfeiffer | 418/83 |
| 2,353,965 | 7/1944 | Meador | 418/83 |
| 2,677,944 | 5/1954 | Ruff | 418/85 |

FOREIGN PATENT DOCUMENTS

| | | | |
|---|---|---|---|
| 688172 | 5/1930 | France | 418/83 |

OTHER PUBLICATIONS

Demag–Wittig–Kompressor–Vakuumpumpen für Saugfahrzeuge and stationäre Anlagen, Oct. 1986, pp. 10–14.

*Primary Examiner*—John J. Vrablik

*Attorney, Agent, or Firm*—Cohen, Pontani Lieberman, Pavane

[57] ABSTRACT

A single-stage vane compressor is provided which includes a casing that has a bore hole running from one end to another end, an outer contour, a water-cooled jacket, a rotor eccentrically arranged in the casing borehole and a rotational axis symmetric with the outer contour of the casing. The rotor has a top dead center position and a bottom dead center position, and the bore hole is arranged in the casing so as to be eccentric to the rotor axis toward the top dead center. A suction flange and an ejection flange are arranged opposite one another in the casing jacket along a common axis normal to the rotor axis, which common axis forms an axis of symmetry with the outer contour of the casing. Two axially parallel walls are arranged in the jacket in a vertical plane of symmetry so as to divide the cooling jacket relative to a suction side and an ejection side. Additionally, two water-cooled covers are provided, one of the covers being arranged on each end of the casing so as to cover the bore hole.

1 Claim, 2 Drawing Sheets

SINGLE-STAGE VANE COMPRESSOR WITH WATER-COOLED JACKET

BACKGROUND OF THE INVENTION

1. Field of the Invention

The invention is directed to a single-stage vane compressor with a water-cooled cover.

2. Description of the Prior Art

Single-stage water-cooled vane-type compressors are known generally and are used for various purposes, e.g., for suction vehicles and stationary installations (see brochure from the Mannesmann Demag company, "Demag-Wittig compressor vacuum pump for suction vehicles and stationary installations", October 1986, pages 10 to 14). These water-cooled vane compressors have a casing provided with feet and a cooling water jacket. A rotor which is provided with radially movable slides is arranged in this casing so as to be off-center with respect to the casing bore hole and its shaft journal is supported in bearings by covers arranged at the end faces of the casing. Flanges for sucking out and ejecting the medium are arranged at the casing jacket so as to be offset along the circumference. This construction, which has been in use for years, has the disadvantage of sharp variations in temperature distribution along the circumference and larger sealing gaps must be provided because of distortion in the casing. However, larger sealing gaps are a sign of poor efficiency, since the magnitude of the sealing gap has a very substantial influence on efficiency due to power loss.

DE-OS 1403608 discloses a water-cooled single-stage vane compressor of the generic type in which the cooled casing jacket is divided into ducts by substantially longitudinal walls distributed along the circumference. In one embodiment, one of the longitudinal walls has no opening, the inlet for cooling water being arranged on one side of the dividing wall while the outlet is arranged on the other side. In this way, the cooling water is compelled to run along a zigzag path through the casing jacket. In another construction, the jacket space is divided into two through-flow systems by a transverse wall disposed vertically to the axis of rotation. This construction has the disadvantage that the elevated temperature level prevailing in the delivery region is influenced only negligibly by the suggested arrangement of the cooling ducts.

DE-OS 36 03 809 describes a two-stage vane compressor in which the rotor axis is arranged symmetrically to the outer contour of the casing. The covers and casing jacket are liquid-cooled and the coolant space is not divided. Therefore, the temperature distribution varies sharply along the circumference and larger sealing gaps must be provided because of the distortion of the casing.

SUMMARY OF THE INVENTION

Accordingly, it is an object of the present invention to provide a vane compressor which can be operated with narrower sealing gaps and has improved efficiency.

Pursuant to this object, and others which will become apparent hereafter, one aspect of the present invention resides in a single-stage vane compressor having a casing with a bore hole running therethrough from end to end, and a water-cooled jacket. A rotor is eccentrically arranged in the casing borehole: and has a rotational axis symmetric with the outer contour of the casing. The rotor has a top dead center position and a bottom dead center position and the bore hole is arranged in the casing so as to be eccentric to the rotor axis in the direction of the top dead center position. A suction flange and an ejection flange are arranged opposite one another in the casing jacket along a common axis normal to the rotor axis. The common axis of the flanges forms an axis of symmetry with the outer contour of the casing. Two axially parallel walls are arranged in the jacket in a vertical plane of symmetry so as to divide the cooling jacket relative to a suction side and an ejection side. Finally, two water-cooled covers are arranged on the ends of the casing.

In contrast to the known prior art, the rotary compressor according to the present invention has no continuous cooling water jacket, but rather has cooling ducts extending along the covers so that a compulsory or forced circulation is achieved. To this end, the cooling water jacket is divided axially with respect to the suction side and delivery side and the suction side and delivery side of the cooling water jacket are connected via the casing cover. In a further step, the cooling water inlet is situated in the top dead center region, specifically so as to be offset along the longitudinal extension of the casing. In order to achieve uniform temperature distribution in the circumferential direction, the cooling chambers in the bottom dead center region are larger than those in the top dead center region. A uniform temperature distribution in the circumferential direction is achieved by means of the compulsory circulation of the cooling water and by the arrangement of larger cooling water ducts in the region of the bottom dead center so as to allow narrower sealing gaps in the bottom dead center region. Narrower sealing gaps result in improved efficiency compared with known compressors. Moreover, the uniform temperature distribution minimizes the different longitudinal expansion on the suction side and delivery side. Accordingly, there are also narrower gaps in the front end region which further improves the efficiency of the machine.

The arrangement of larger cooling chambers in the bottom dead center region is effected in that the rotor axis coincides with the center axis of the casing and the casing bore hole is arranged eccentrically thereto. Along with the steps mentioned above, the feet and flanges are arranged symmetrically to the rotor axis enabling universal or general-purpose installation in vehicles. The centricity of the rotor shaft and conformity to the axis of the driving device are maintained regardless of which longitudinal side of the compressor is used as the impact surface or stop face.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
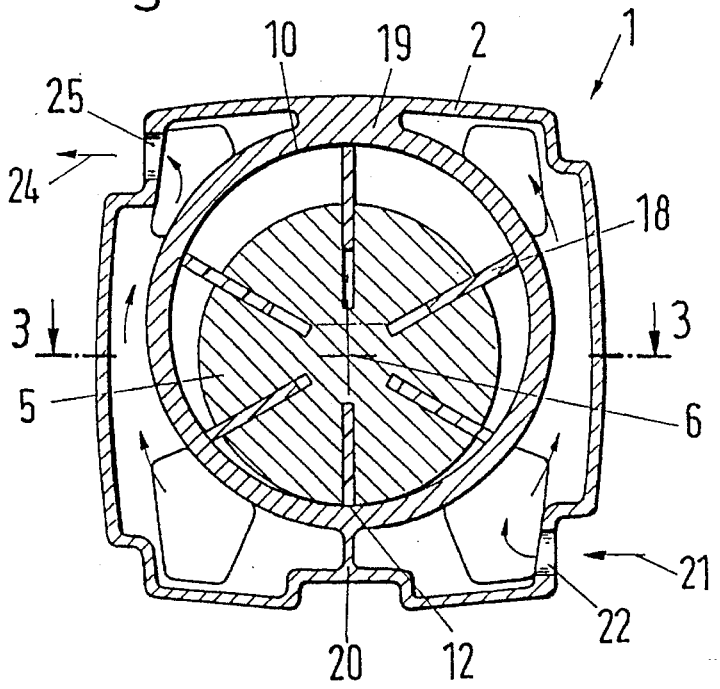
FIG. 1 shows a cross section of a water-cooled rotary compressor according to the invention along line 1—1 in FIG. 3.
Figure 2:
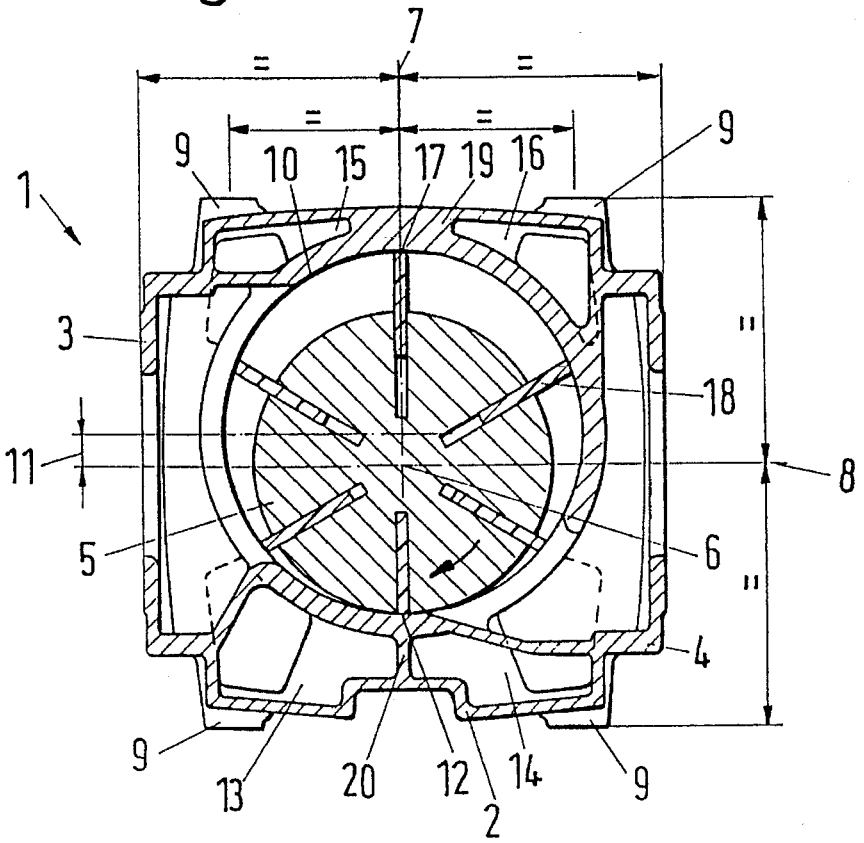
FIG. 2 shows a cross section along line 2–2 in FIG. 3.
Figure 3:
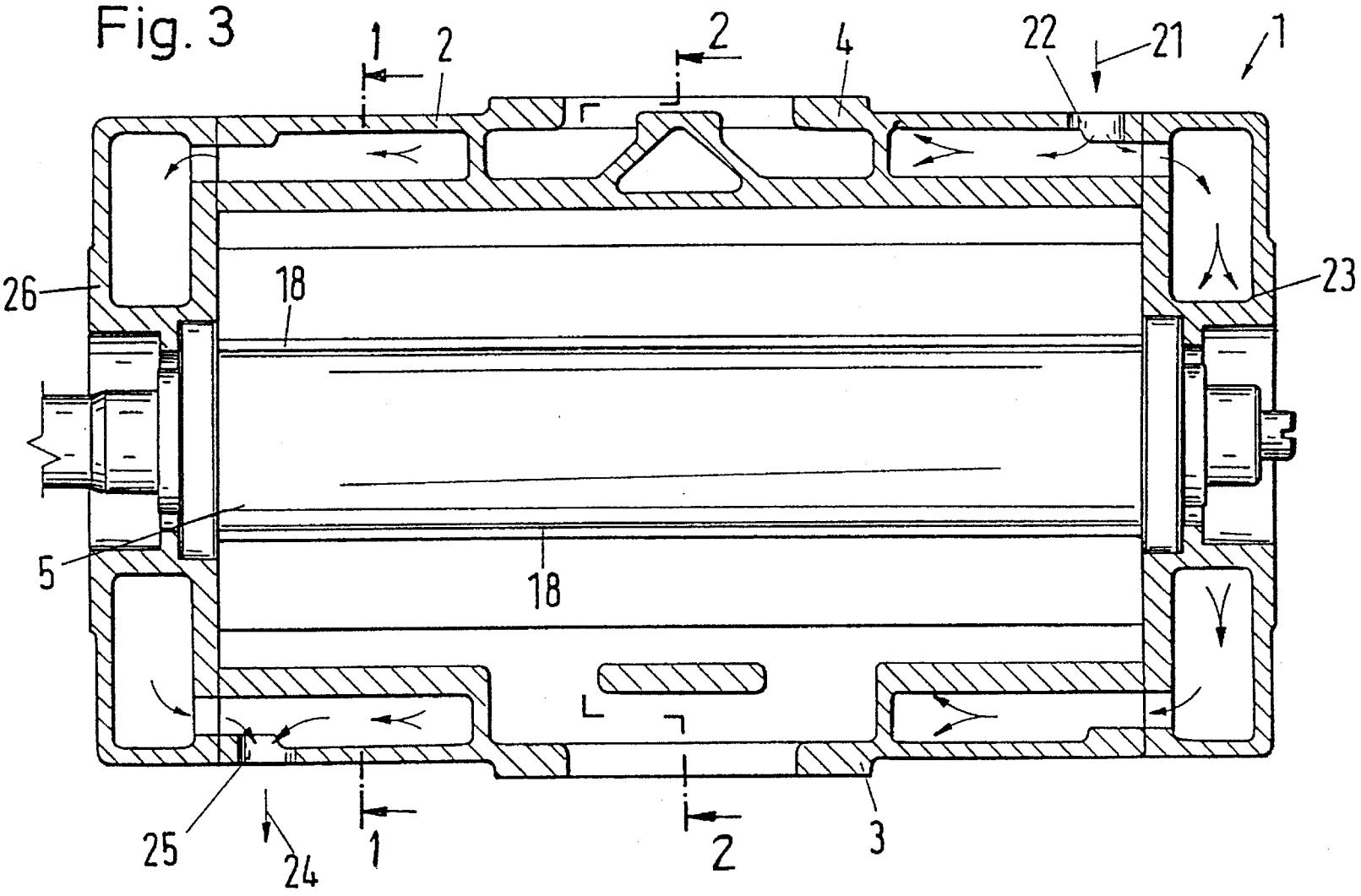
FIG. 3 shows a longitudinal section along line 3—3 in FIG. 1.

A water-cooled rotary compressor 1 according to the invention is shown in two cross-sectional views and in longitudinal section in FIGS. 1 to 3. This rotary compressor 1 has a one-piece casing 2 having cooling ducts in the upper region and lower region. The flanges 3, 4 for the suction side and delivery side are also integrated in the casing 2. The central arrangement of the rotor 5 with reference to the center axis 6 of the casing 2 is shown in FIGS. 1 and 2. To illustrate this centricity, the distance in the x direction from the center axis 7 to the end faces of the flanges 3, 4 and to the axes of the feet 9 and the distance in the y direction from the center axis 8 to the end faces of the feet 9 are provided with equal signs in FIG. 2. In contrast to the conventional centric arrangement of the casing bore hole with reference to the center point of the casing 2, the casing bore hole 10 according to the invention is arranged eccentrically relative to the rotor axis 6. This eccentricity is illustrated in the drawing by the displacement 11 in the y direction.

The advantage of the offset arrangement of the casing bore hole 10 is that cooling chambers 13, 14 can be arranged in the region of the bottom dead center 12 and in the region of the delivery flange 4 which are larger compared to the cooling chambers 15, 16 in the region of the top dead center 17 and the suction flange 3. Since the greatest heat occurs in the delivery flange region due to the adiabatic compression of the medium and the friction of the slides 18, a particularly intensive cooling is desirable in this region in order to render the temperature distribution as uniform as possible in the circumferential direction.

The cooling is further improved by dividing the cooling jacket axially by walls 19, 20 which lie axially parallel in a vertical plane of symmetry. The flow of water is indicated by the arrows in FIGS. 1 and 3. The cooling water enters 21 in the region of the bottom dead center 12 at the outermost edge of the longitudinal extension of the casing 2 (on the right in this embodiment). The cooling water inlet; 22 is situated in the sectional plane in FIG. 1 for the purpose of illustration. After the inlet opening 22, the cooling water flows in the longitudinal direction of the casing (from right to left in this embodiment) and, at the same time, from bottom to top. At the same time, the cooling water flows via the recesses provided in the cover 23 on the other side :and continues in the longitudinal direction of the casing 2 so that the jacket region located opposite the inlet opening 22 is also adequately cooled. A reversal of flow is effected in the region of flanges 3, 4 so that the suction duct and pressure duct remain free. At the end of the longitudinal extension of the casing 2, the cooling water which has been heated in the meantime exits at 24, more particularly, through an opening 25 arranged in the top of the casing in the suction region 3. The outlet opening 25 is situated in the sectional plane in FIG. 1 to illustrate its position. A reversal of flow is effected through the recesses arranged in the cover 26 on the left analogous to the arrangement at the inlet so that the cooling water flowing along the jacket surface on the delivery side can exit again. A direct connection between the jacket surface on the delivery side and that on the suction side and accordingly a short circuiting of the cooling water is prevented by the transverse webs 19, 20 mentioned above.

The invention is not limited by the embodiments described above which are presented as examples only but can be modified in various ways within the scope of protection defined by the appended patent claims.

I claim:

1. A single,stage vein compressor, comprising: a casing having a bore hole running from one end to another end, an outer contour and a water-cooled jacket, the casing jacket having a cooling water inlet in a bottom dead center region and a cooling water outlet in a top dead center region that are offset relative to a longitudinal axis of the casing, the casing further having cooling water chambers in the bottom dead center region and in the top dead center region, the cooling chambers in the bottom dead center region being larger than those in the top dead center region; a rotor eccentrically arranged in the casing borehole and having a rotational axis symmetric with the outer contour of the casing, the rotor having a top dead center position and a bottom dead center position, the bore hole being arranged in the casing so as to be eccentric to the rotor axis toward the top dead center; a suction flange and an ejection flange arranged opposite one another in the casing jacket along a common axis normal to the rotor axis, which common axis forms an axis of symmetry with the outer contour of the casing; two axially parallel walls arranged in the jacket in a common vertical plane which passes through the rotor:axis so as to divide the jacket relative to a suction side and an ejection side; two water-cooled covers, one of the covers being arranged on each end of the casing so as to cover the bore hole, each of the covers having recesses adapted to place the ejection side of the casing jacket in fluid communication with the suction side; and, a plurality of shut-off slides mourned to the rotor so as to be radially movable relative to the rotor.

* * * * *